United States Patent [19]

Rech et al.

[11] 4,318,024

[45] Mar. 2, 1982

[54] FLASH TUBE

[75] Inventors: Werner Rech, Taunusstein; Wolfgang Welsch, Wiesbaden; Josef Zimlich, Taunusstein, all of Fed. Rep. of Germany

[73] Assignee: Heimann GmbH, Fed. Rep. of Germany

[21] Appl. No.: 89,618

[22] Filed: Oct. 29, 1979

[30] Foreign Application Priority Data

Nov. 10, 1978 [DE] Fed. Rep. of Germany ..... 2848891

[51] Int. Cl.[3] ..... H01J 17/16

[52] U.S. Cl. ..... 313/220; 313/179; 313/217; 313/218; 313/246

[58] Field of Search ..... 313/220, 217, 218, 178, 313/179, 310, 246

[56] References Cited

U.S. PATENT DOCUMENTS

| | | | |
|---|---|---|---|
| 3,098,166 | 7/1963 | Goldberg | 313/179 |
| 3,312,853 | 4/1967 | Mela | 313/218 |
| 3,363,133 | 1/1968 | Harris et al. | 313/218 X |
| 3,390,296 | 6/1968 | Smith | 313/246 X |
| 3,549,936 | 12/1970 | Hama et al. | 313/178 |
| 3,693,007 | 9/1972 | Kerekes | 313/220 X |
| 3,748,519 | 7/1973 | Martin et al. | 313/178 |
| 4,099,084 | 7/1978 | Hoene | 313/220 X |
| 4,203,050 | 5/1980 | Rech et al. | 313/220 |

FOREIGN PATENT DOCUMENTS

| | | | |
|---|---|---|---|
| 2713702 | 10/1978 | Fed. Rep. of Germany | 313/220 |
| 49-15013 | 4/1974 | Japan | 313/220 |
| 52-55282 | 5/1977 | Japan | 313/178 |

*Primary Examiner*—Stanley T. Krawczewicz
*Attorney, Agent, or Firm*—Hill, Van Santen, Steadman, Chiara & Simpson

[57] ABSTRACT

A flash tube is disclosed having metallic end caps attached either in the shape of a plate or a cup upon ends of a glass or quartz tube. They are attached by adhesive, or are soldered on by soldering glass. One of the end caps internally supports a sintered body as a cathode. Soldering temperatures and a distance of the sintered body from the soldered joint when soldering glass is used are chosen such that no activating metal of the sintered body evaporates, since this reduces the work function of the electrons at the ends of the tube.

12 Claims, 2 Drawing Figures

FLASH TUBE

BACKGROUND OF THE INVENTION

The invention relates to a flash tube formed of a hollow-cylindrical tube made of hard glass or quartz. Metallic end caps are attached to each of the ends of the tube so as to be gas-tight and which may support electrodes in the tube interior. The tube is filled with gas, preferably inert gas.

A flash tube of this kind is well-known and described in U.S. Pat. No. 4,099,084, incorporated herein by reference, as a pulse discharge lamp. For example, flash equipment currently in demand by consumers should be more compact and, perhaps, already built into cameras. Therefore, the trend for ever smaller flash tubes exists. A considerable contribution along these lines is to no longer use wire ducts through glass as electrode supply lines, but rather to seal the glass or quartz tube of the flash tube by means of a metallic end cap, wherein these metallic end caps form not only the seal but also perform the function of the electrode supply line. In this way, both functions require only a small portion of the overall constructional length of the flash tube. The discharge length of the gas discharge in the interior of the tube, and which is essential for the light yield, is then nearly the same as the external construction length. The entire discharge space is filled with the light-producing plasma.

This compact type of construction also has the advantage of simple production. Inside a large container, many flash tubes can be filled with gas all at once, and the hermetic sealing can take place under the filling pressure universally prevailing.

If, however, it is desired to increase the filling pressure, especially to obtain a higher light yield, then the hermetic sealing presents several difficulties because the gas pressure rises quickly and becomes high during the gas discharge, and glass-metal type connections do not have much stability against tensile stresses. For this reason it is suggested in U.S. Pat. No. 4,099,084 to attach the metallic end caps, not to the ends of the tube, but to melt them onto the inner surfaces of the tube ends. In this way mainly shear stresses, caused by the pressure, occur, which the melting connection can endure better than tensile stresses.

This arrangement, however, has decisive disadvantages. Not only do the coefficients of thermal expansion of metal and glass have to be matched, but as a consequence of that, expensive tungsten has to be used. Another disadvantage is that, for the purpose of melting the quartz or hard glass necessary for the working load, such high temperatures are necessary that it cannot be guaranteed that the geometrical conditions at the tube ends will be maintained. Also, activating substances, which are located in the cathode for reducing the work function, evaporate and can cause a short-circuiting lining on the inner sides of the tube.

SUMMARY OF THE INVENTION

It is an object of the present invention to create a flash tube of compact construction having metallic end caps, which minimizes construction length, but does provide more favorable conditions for the production and operating reliability. It is desirable that low production cost and operation not be in conflict with one another. In particular, it is desirable that the high temperatures required for production according to the prior art are avoided.

To achieve these objects in the case of a flash tube of the kind decribed above, in accordance with the invention the following characteristics are employed. The gas-tight connection of the end caps with the tube ends takes place in each case via a soldering glass ring or via an organic adhesive. A cathode in the shape of a sintered body is attached to the inner side of one end cap. The sintered body has a metallic grid structure and contains a substance which reduces the work function of the electrons. The sintered body has, at least in the case where the end caps are soldered on, an essentially smaller diameter than the internal diameter of the tube in order that the substance reducing the work function is, as far as possible, not drawn away or evaporated by the heating of the soldered joint.

The solution in accordance with the invention involves two alternatives. The connection of the end caps with the tube ends via an organic adhesive results in the advantage that the temperature problem is of no importance for production. However, the internal pressures employed are limited, and the durability of the flash tube depends a great deal on the quality of the adhesive. The concession to constructional length is the least here, since in the simplest case a plain end plate is sufficient, and the sintered body as a cathode can then occupy the entire clear surface on the inner side of the end plate. Extremely high current densities are possible without the end plate as an electrode supply line being exposed to danger. The axial length of the sintered body may be of minimum size.

In the second alternative a gas-tight connection via soldering glass is provided which requires local heating for the soldered joint. This heating is essentially less than one for a melting process of metal in hard glass or quartz. In this case, however, the sintered body does not occupy the entire clean surface on the inner side of the end cap, so that the danger of evaporation of the activating substance does not arise.

With both alternatives it is, however, possible to use an inexpensive metal for the end caps. In this way, in addition to the choice of the metal or hard glass, the connecting link soldering glass or organic adhesive provides for the adaptation of the coefficients of thermal expansion. Nowadays, it is possible to produce a connection between inexpensive metals and heavy-duty hard glasses which is thermomechanically secure in the presence of high pressures, and wherein the glass solder has a coefficient of thermal expansion between those of the metal or metal alloy used and of the hard glass or quartz.

Generally speaking, it is well-known from U.S. Pat. No. 3,693,007 incorporated herein by reference to solder end caps onto the ends of the glass or ceramic tube of a gas-discharge tube. But there it is exclusively a matter of end caps made of glass or ceramics, i.e., the same materials. Therefore, different coefficients of thermal expansion are of no importance. There, the electric supply is accomplished by means of a metal lining around the entire end caps. The present invention, however, utilizes metallic end caps, which is unequivocally better for the supply line.

Several designs of a flash tube in accordance with the invention are concerned with the provision of a getter. According to one design, at least one of the end caps consists of a getter metal, such as titanium, tantalum or zirconium. According to another design, the sintered body contains a getter metal, such as titanium, tantalum or zirconium, and is welded internally onto the end cap supporting it.

A further possibility to attach the sintered body onto the end cap at the cathode side is to weld a metal pin onto the inner side of one end cap, which metal pin projects into the interior of the tube and upon which the sintered body is fastened, in particular in the shape of a ring and by pressing. This has the advantage that it is easier to weld a metal pin than a large sintered body. Here, the metal pin consists of a metal, such as tungsten, molybdenum or a Ni-Fe-Co alloy. According to an advantageous design of this kind of fastening, the metal pin consists of a getter metal, such as titanium, tantalum or zirconium. Here, it is no longer necessary that the sintered body itself contains a getter metal or that an end cap of getter metal exists.

Further designs refer to the provision of the end caps themselves. In the simplest case, they consist of metal discs which are blanked out from the sheet metal. A further development resides in the fact that end caps are drawn in the shape of a cup, wherein each cup base extends into the tube interior and the cup rim rests upon the tube ends. This shape of cup has two advantages. On the one hand, during production, centering is simple. The cups and tubes are simply placed one on top of the other and center themselves by their shape. Centering externally is not necessary. On the other hand, external contacting can easily be centered. Spring contacts press into the cavity of the cups, so as to center, and provide for exact mounting as well as for the current supply.

DESCRIPTION OF THE PREFERRED EMBODIMENTS

Figure 1:
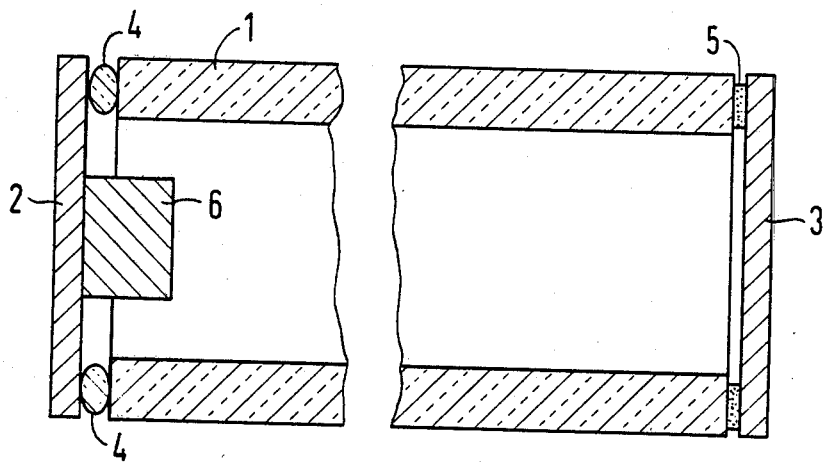
FIG. 1 illustrates in cross section a flash tube having plate-shaped end caps in accordance with the invention.

In FIG. 1, a cylindrical tube made of quartz or hard glass is designated 1. On the left end of the tube 1 an end plate 2 is fastened via a soldering glass ring 4, and on the right end an end plate 3 is fastened via an organic adhesive 5. The two end plates 2 and 3 are blanked out from sheet metal, for example from tungsten, molybdenum, or from a Ni-Fe-Co alloy, wherein tungsten represents the expensive version which, as a matter of fact, should be avoided. Preferably, the soldering glass ring 4 is prefabricated by press-working or sintering. A cylindrical sintered body 6 is welded coaxially on the inner side of the end plate 2. The diameter of this sintered body 6 is essentially less than the internal diameter of tube 1, for example, about half the size. The two end caps 2 and 3 are connected to the tube 1, so as to be gas-tight, via the soldered glass ring 4 or the adhesive coat 5. The sintered body 6 serves as a cathode, and the inner side of the end plate 3 itself serves as an anode. The sintered body 6 consists of a metallic grid structure made of a binding material, such as nickel, mixed with a getter metal, such as titanium, tantalum or zirconium, and is impregnated with a metal, such as barium or cesium, as an activating agent, which facilitates the work function of the electrons. The different connections of the end plates 2 and 3 with the tube 1 has been chosen for the sake of an example of both types in the preferred embodiment. In practice, the same technique is used for both connections.

Figure 2:
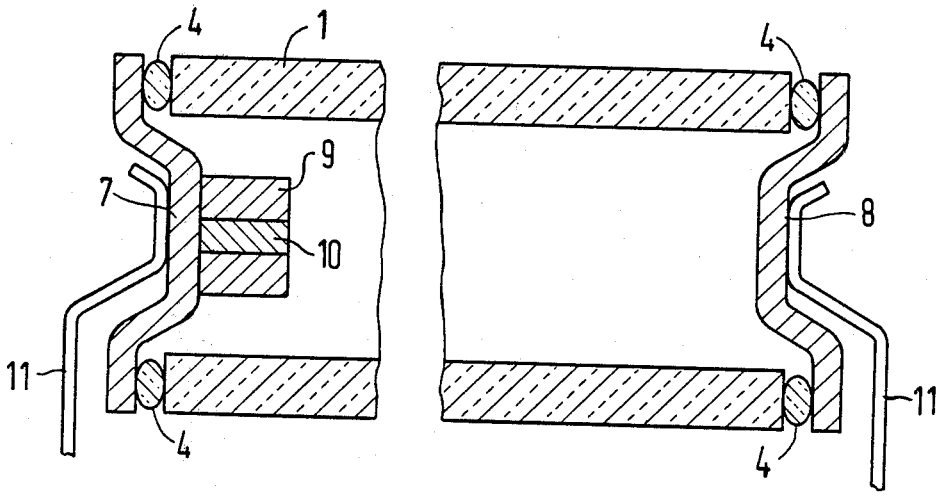
FIG. 2 illustrates a cross section flash tube having cup-shaped end caps in accordance with the invention.

FIG. 2 again shows a tube 1 made of hard glass or quartz. Here, two end caps 7 and 8 are developed in the shape of a cup, wherein the cup bases extend into the interior of the tube 1. Cup-shaped end caps of this kind are most easily manufactured by deep-drawing and blanking-out from appropriate sheet metal, for example again from tungsten, molybdenum or a Ni-Fe-Co alloy. Here, the cup sides are slightly conical. In this way, the centered position of tube 1 is made easier for production. The inner side of one cup base, i.e., the side of the end cap 7 facing the tube interior, supports a welded on metal pin 10, for example made of tungsten, molybdenum or a Ni-Fe-Co alloy, and upon which a ring-shaped sintered body 9 serving as a cathode is pressed on. The cup base of the end cap 8 itself serves again as an anode. The rims of the end caps 7 and 8 are soldered onto the front ends of the tube 1 via glass soldering rings 4. As one alternative, the metal pin 10 itself consists of a getter metal, such as titanium, tantalum or zirconium. According to the other alternative, the end cup 8, or both end caps 7 and 8, consist of such a getter metal instead of the afore-mentioned metal, like tungsten, molybdenum or a Ni-Fe-Co alloy. Two contact springs, which from the outside reach into the cup cavities and there undertake the mechanical mounting of the flash tube and simultaneously the external electric contacting, are designated 11. In this way, the shape of the cup facilitates centering for mounting and contact.

We claim as our invention:

1. A flash tube comprising: a hollow cylindrical tube comprised of an element selected from the group consisting of hard glass and quartz; solid metallic sheet metal end caps attached to each end of the tube in a gas-tight connection and which support and act as electrical connection leads to electrodes in the tube interior located directly at an inner surface of each of the end caps; a gas filling in the tube; the gas tight connection of the end caps with the tube ends each comprising a soldering glass ring between the end cap and an end surface of the tube; a cathode in the shape of a sintered body attached and located directly at an inner side of one end cap; the sintered body having a metallic grid structure and containing a getter metal as a means for reducing a work function of electrons at the cathode; and the sintered body having a diameter sufficiently smaller than the internal diameter of the tube so as to reduce damage to the means for reducing the work function during heating of the soldering glass ring.

2. The tube of claim 1 wherein the getter metal is comprised of an element selected from the group consisting of titanium, tantalum, and zirconium.

3. A flash tube of claim 1 wherein the sintered body is welded on one of the end caps.

4. The tube of claim 3 wherein the getter metal comprises an element selected from the group consisting of titanium, tantalum and zirconium.

5. A flash tube of claim 1 wherein on the inner side of one end cap a metal pin is welded which projects into an interior of the tube and to which the sintered body is fastened.

6. A flash tube of claim 5 wherein the metal pin comprises a getter metal.

7. A tube according to claim 6 wherein the getter metal comprises an element selected from the group consisting of titanium, tantalum, and zirconium.

8. A flash tube of claim 1 wherein the end caps comprise a planar piece of blanked out sheet metal.

9. A flash tube of claim 8 wherein the end caps comprise a drawn cup, a base of each cup extending into the tube interior, and a rim of the cup resting upon the tube ends.

10. The tube of claim 1 wherein the gas filling comprises inert gas.

11. The tube of claim 5 wherein the sintered body comprises a ring press fit on the metal pin.

12. A flash tube comprising: a hollow cylindrical tube comprised of an element selected from the group consisting of hard glass and quartz; solid metallic sheet metal end caps attached to each end of the tube in a gas-tight connection and which support and act as electrical connection leads to electrodes in the tube interior located directly at an inner surface of each of the end caps; a gas filling in the tube; the gas tight connection of the end caps with the tube ends each comprising a ring of organic adhesive between the end cap and an end surface of the tube; a cathode in the shape of a sintered body attached and located directly at an inner side of one end cap; the sintered body having a metallic grid structure and containing a getter metal as a means for reducing a work function of electrons at the cathode; and the sintered body having a diameter smaller than the internal diameter of the tube.

* * * * *